United States Patent [19]

Schobermayr et al.

[11] Patent Number: 4,822,026

[45] Date of Patent: Apr. 18, 1989

[54] PLAYING SURFACES

[76] Inventors: Harald Schobermayr, Heipelweg 9/4; Erwin Krumboeck, Judendorferstrasse 33, both of A-8706 Leoben, Austria

[21] Appl. No.: 472,666

[22] Filed: Mar. 7, 1983

[30] Foreign Application Priority Data

Mar. 8, 1982 [EP] European Pat. Off. ..... 82-890036.5

[51] Int. Cl.[4] ..... E01C 13/00

[52] U.S. Cl. ..... 272/3

[58] Field of Search ..... 272/56.5 SS, 3, 4, 5; 428/17, 143, 147, 402, 206; 83/906; 273/29 R, DIG. 13

[56] References Cited

U.S. PATENT DOCUMENTS

| | | | |
|---|---|---|---|
| 3,736,847 | 6/1973 | Hickey | 272/56.5 SS |
| 3,801,421 | 4/1974 | Allen et al. | 428/17 |
| 4,341,836 | 7/1982 | Becker | 273/29 R X |

FOREIGN PATENT DOCUMENTS

| | | | |
|---|---|---|---|
| 2813761 | 10/1979 | Fed. Rep. of Germany | 272/3 |
| 2498463 | 7/1982 | France | 272/3 |
| 74723 | 7/1978 | Japan | 272/3 |
| 74725 | 7/1978 | Japan | 272/3 |

*Primary Examiner*—Robert A. Hafer

*Attorney, Agent, or Firm*—Bierman and Muserlian

[57] ABSTRACT

Substantially planar, horizontal athletic fields comprising a substrate provided with a finish or coating of particles of an elastic plastic in the form of flat plates or scales whose length is at least 1.5 times the thickness of the plate or scale and a method of improving the abrupt braking qualities of an athletic field and the said particles.

10 Claims, 1 Drawing Sheet

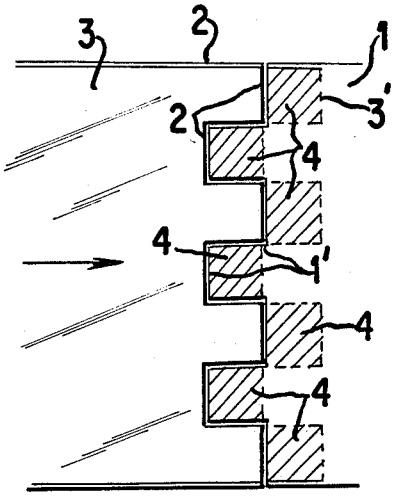
3
2
1
2
3'
4
4
1'
4
4

PLAYING SURFACES

STATE OF THE ART

Sports such as tennis require a player to do much running in starting up, accelerating and frequent abrupt braking and are usually played on grass fields or hard courts or playgrounds provided with a surface of loosely poured and rolled brick dust. An essential advantage of the brick dust courts is that the player skids slightly during braking rather than abrupt stops so that peak stresses to be absorbed by the player's body are reduced to lessen the danger of injury to the joints and ligaments of the legs. Also, the elasticity, damping and friction characteristics of a rolled brick dust coating are also favorable advantages for this use.

However, brick dust courts are very expensive to maintain since the court must be rolled and wetted regularly since if the surface is too dry, there is a tendency for development of dust. Moreover, the brick dust is subjected to constant wear and must be periodically replaced. Because of necessity for replacement and wetting, the brick dust courts have only been used occasionally for indoor courts because of the unpleasant high humidity caused by wetting indoors.

German DE-OS 26 02 652 describes loosely distributed particles with a plate like or lentil bean shape with a maximum particle diameter of 2 to 5 mm for use as an artifical ski slope. However, in skiing the loosely poured particles on the slope are moved sidways by the edges of the skis when changing direction similar to snow particles. However, when braking such as in tennis, the sideways movement of the particles is not desired.

U.S. Pat. Nos. 3,736,847, 3,291,486 and 3,731,923 all relate to materials for artifical ski slopes.

Swiss Patent No. 611,959 has proposed avoiding the drawback of brick dust coatings for tennis courts by providing a carrier layer in which stabilizing grains such as rubber are firmly embedded therein so that they protrude from the carrier layer about one third of their height. A relatively thin top coat of finely granulated rubber particles with a grain size of 0.5 to 1.5 mm is applied to the said carrier layer to fill the spaces between the stabilizing grains projecting from the carrier layer to cover the tops thereof.

When the player pushes off from the coating, the tips of the stabilizing grains are engaged by the profile sole of the tennis-or athletic shoe, which permits e.g. a satisfactory push-off in starting. The slight skidding desired in braking is ensured by the fine rubber granules of the top coat, whereby a greater lateral displacement of the top coat granules is substantially avoided by the stabilizing grains firmly embedded in the carrier layer. However, such an athletic field coating is expensive to manufacture.

OBJECTS OF THE INVENTION

It is an object of the invention to provide a novel method and apparatus to prepare elastic plastic particles useful as a coating for athletic fields and to the said plastic particles.

It is another object of the invention to provide athletic fields with improved braking qualities and to a novel method of improving the quality of athletic fields.

These and other objects and advantages of the invention will become obvious from the following detailed description.

THE INVENTION

The improved athletic fields of the invention are comprised of a firm substrate provided with a top coating or finish of loosely poured particles of an elastic plastic in the form of flat plates or scales whose length is at least 7.5 times the thickness of the plate or scale. The coating can be applied to any firm base such as asphalt and be removed, cleaned and replaced if necessary.

The coating may be several centimeters thick but it is preferred to only form a finish coat of the particles on the solid substrate which has the advantage that the lines defining the field of play on the substrate can be seen through the finish layer. Thin finish layers can be 0.2 to 0.6 kg per square meter of particles with a plate or scale like form with a thickness of 0.3 to 1.0 mm and a maximum planar dimension of 5 mm, preferably 7.5 to 4 mm.

The elastic plastic particles are preferably based on thermoplastic-resins and/or elastomeric resins and/or a thermoplastic rubber and/or a crosslinked rubber which can contain conventional fillers, stabilizers, plastizers, dyes, and/or pigments and inorganic fillers. However, thermosettting resins are not suitable since they are not elastic enough. The desired particles have only a slight tendency to roll which enhances the adherence of the particles to the solid substrate and gives improved player braking movements due to the increased braking action caused by the desired slight skidding movements.

The novel method of the invention for the preparation of the particles comprises continuously advancing a plastic ribbon with preferably a thickness equal to the desired thickness of the particles over a fixed counter knife provided with a comb-type cutting edge cooperating with a rotor provided with at least one fly cutter whose cutting edges are toothed like a comb which cooperate with the toothing of the counter knife whereby the rotation of the fly cutters cuts the front edge of the plastic ribbon into the desired plate or scale like form.

Referring now to the FIGURE.

The FIGURE is a schematic view of the cutting action of an embodiment of the invention in which a plastic ribbon 3 with a suitable thickness of about 0.7 mm is continuously advanced with its leading edge 3' over a fixed counter knife 2 provided with a comb-like cutting edge 2'. Cooperating with counter knife 2 is a rotor equipped with at least one fly cutter provided with cutting edges 1' toothed like a comb and cooperating with toothing edges 2'. During the rotation of the fly cutters 1, the desired plastic particles 4 are cut from the front edge of the ribbon 3.

In the following examples there are described several preferred embodiments to illustrate the invention. However, it is to be understood that the invention is not intended to be limited to the specific embodiments.

EXAMPLE 1

A ribbon of a thermoplastic rubber of styrene and butadiene sold by Shell Chemie was cut by the apparatus of the FIGURE into particles in the form of thin plates measuring 2 mm $\times$2 mm and having a thickness of 0.6 mm. The said particles were applied to an asphalt tennis court with a broom in an amount of 0.2 to 0.6 kg per square meter to provide a tennis surface comparable to the qualities of a brick dust court without the disadvantages of high maintainence costs. With this small quantity of particles, the base lines painted on the asphalt surface could still be seen and the particles could be easily redistributed with a broom. When the court required cleaning, the particles were removed from the court with a vacuum cleaner and the particles were separated from the dirt and reused.

EXAMPLE 2

A ribbon of a thermoplastic polyurethane polymer based on polyesters, polyisocyanates and chain extenders of the 400 series sold by Europolymers Ltd was cut into particles with a plate-like form with a thickness of about 0.7 mm which were useful coating asphalt tennis courts.

EXAMPLE 3

A ribbon of Baysport one-or two-component polyurethane cold-hardening system based on a modified MDI (diphenylmethane-4, 4'-diisocyanate) and an ether-glycol mixture was cut into particles with the apparatus of the FIGURE to obtain particles useful as a coating for tennis courts.

EXAMPLE 4

A ribbon of polyvinylchloride modified with a polyurethane elastomer sold under the name Elvaloy 741 was cut into plate-like particles which were useful for improving the braking qualities of a hard-surfaced tennis court.

EXAMPLE 5

A ribbon of a crosslinked rubber based on a system of styrene-butadiene (type 1605 SHELL CHEMICALS) with proper vulcanizers and accelerators was cut into plate-like particles, which were useful for coating asphalt tennis courts.

Various modifications of the products and method of the invention may be made without departing from the spirit or scope thereof and it should be understood that the invention is intended to be limited only as defined in the appended claims.

What we claim is:

1. a substantially planar horizontal athletic field comprising a firm substrate provided with a top coating or finish of loosely poured particles of an elastic plastic in the form of flat plates or scales whose length is at least 7.5 times the thickness of the plate or scale.

2. The field of claim 1 wherein the particles have a maximum thickness of 1.5 mm and a maximum planar dimension of 5 mm.

3. The field of claim 2 wherein the thickness of the particles is 0.3 to 1.0 mm and the amount of particles on the substrate is 0.2 to 0.6 kg per square meter as a finish.

4. The field of claim 1 wherein the particles are based on a thermoplastic polyurethane elastomer.

5. The field of claim 1 wherein the particles are based on a one- or two component polyurethane-system.

6. The field of claim 1 wherein the particles are based on a thermoplastic rubber.

7. The field of claim 1 wherein the particles are based on a modified PVC-compound.

8. The field of claim 1, wherein the particles are based on a crosslinked rubber.

9. An athletic field of claim 1 wherein the coating is a finish layer wherein the lines on the field can be seen through the finish layer.

10. An athletic field of claim 1 wherein the plates or scales are substantially square.

* * * * *